US006932031B2

(12) United States Patent
Adams

(10) Patent No.: US 6,932,031 B2
(45) **Date of Patent: *Aug. 23, 2005**

(54) SCAVENGING SYSTEM FOR INTERMITTENT LINEAR MOTOR

(75) Inventor: Joseph S. Adams, 481 Beaver Point Road, Salt Spring Island, BC (CA) V8K 2J9

(73) Assignee: Joseph S. Adams, British Columbia (CA)

( * ) Notice: Subject to any disclaimer, the term of this patent is extended or adjusted under 35 U.S.C. 154(b) by 0 days.

This patent is subject to a terminal disclaimer.

(21) Appl. No.: 10/731,993

(22) Filed: Dec. 9, 2003

(65) Prior Publication Data

US 2005/0120983 A1 Jun. 9, 2005

(51) Int. Cl.[7] ..... F02B 71/00
(52) U.S. Cl. ..... 123/46 R
(58) Field of Search ..... 123/46 R, 46 A, 123/46 B, 46 SC, 46 H

(56) References Cited

U.S. PATENT DOCUMENTS

| | | | |
|---|---|---|---|
| 4,043,248 | A | 8/1977 | Bulman et al. |
| 4,377,991 | A | 3/1983 | Liesse |
| 4,616,622 | A | 10/1986 | Milliman |
| 4,665,868 | A | 5/1987 | Adams |
| RE32,452 | E | 7/1987 | Nikolich |
| 4,759,318 | A | 7/1988 | Adams |
| 5,125,320 | A | 6/1992 | Zielinski |
| 5,199,626 | A | 4/1993 | Terayama et al. |
| 5,257,614 | A | 11/1993 | Sullivan |
| 5,333,594 | A | 8/1994 | Robinson |
| 5,499,567 | A | 3/1996 | Gay |
| 5,540,194 | A | 7/1996 | Adams |
| 5,613,483 | A | 3/1997 | Lukas et al. |
| 5,769,066 | A | 6/1998 | Schneider |
| 5,771,621 | A | 6/1998 | Rogers |
| 5,771,875 | A | 6/1998 | Sullivan |
| 5,967,133 | A | 10/1999 | Gardner et al. |
| 6,003,504 | A | 12/1999 | Rice et al. |
| 6,138,656 | A | 10/2000 | Rice et al. |
| 6,233,928 | B1 | 5/2001 | Scott |
| 6,343,599 | B1 | 2/2002 | Perrone |

(Continued)

FOREIGN PATENT DOCUMENTS

| | | |
|---|---|---|
| JP | 60104806 | 6/1985 |
| JP | 4136696 | 5/1992 |
| JP | 5215492 | 8/1993 |
| JP | 6185894 | 7/1994 |

*Primary Examiner*—Henry C. Yuen
*Assistant Examiner*—Hyder Ali
(74) *Attorney, Agent, or Firm*—Brian B. Shaw, Esq.; Thomas B. Ryan; Harter, Secrest & Emery LLP

(57) ABSTRACT

The intermittent linear motor of this invention incorporates features which enhance the exhaust scavenging and cooling processes, as well as simplifying overall construction including a compression plenum below the piston where air displaced during a power stroke by the piston is immediately transferred through the combustion chamber allowing said compressed air to immediately begin scavenging exhaust gases as the piston is returned further displacing spent gases from the motor.

14 Claims, 4 Drawing Sheets

U.S. PATENT DOCUMENTS

| | | | |
|---|---|---|---|
| 6,371,099 | B1 | 4/2002 | Lee |
| 6,418,920 | B1 | 7/2002 | Marr |
| 6,474,326 | B1 | 11/2002 | Smith et al. |
| 6,491,002 | B1 | 12/2002 | Adams |
| 6,634,325 | B1 | 10/2003 | Adams |
| 6,647,969 | B1 | 11/2003 | Adams |
| 2002/0088449 | A1 | 7/2002 | Perrone |
| 2003/0005918 | A1 | 1/2003 | Jones |
| 2003/0110758 | A1 | 6/2003 | Adams |
| 2003/0131809 | A1 | 7/2003 | Adams |

SCAVENGING SYSTEM FOR INTERMITTENT LINEAR MOTOR

BACKGROUND OF THE INVENTION

1. Field of the Invention

This invention relates generally to the field of intermittent linear motors for use in combustion gas powered tools such as those used to drive fasteners.

2. Description of Related Art

The cycle of the intermittent linear motor is different from that of a continuous running engine. It does not continue automatically, as would be the case in a reciprocating internal combustion engine. Instead, the intermittent linear motor's power piston must be returned to, and remain in, a starting or rest position between each power stroke. Typically, a rod fitted to the power piston engages a fastener or other load and mechanical energy is transmitted through the rod to drive a fastener or perform other useful work during the power stroke.

The power piston is returned to its starting or rest position within a piston cylinder during a reciprocation stroke by a resilient member, vacuum draw, or return air pressure. This stroke is not generally used for compression purposes as in a conventional engine. Instead, the upper portion of the piston cylinder is vented during reciprocation so that the contents of the combustion chamber in the starting or rest position are at or near atmospheric pressure. This is primarily done because holding a compressed charge for what may be extended periods between cycles has not proven practical. However, as a result of the inherent thermal-to-mechanical output inefficiencies resulting from this lack of compression, the combustion chambers of intermittent linear motors are required to be fairly large for a given power output.

These relatively large uncompressed combustion chambers of intermittent linear motors, as well as being inherently inefficient, are especially sensitive to the presence of residual exhaust gases from previous cycles. Failure to remove such residual gases will result in a diluted charge and deterioration of burn speed, which is critical when driving a fastener. Thus, unless such gases can be substantially completely removed and replaced with a clean air/fuel mixture, subsequent cycles will deliver significantly less power.

It is, therefore, necessary to provide some type of efficient exhaust scavenging system in devices utilizing intermittent linear motors. Such systems should discharge exhaust gases from the tool as quickly as possible after combustion has been completed and useful work performed. This helps prevent the tool from overheating and can also minimize the amount of scavenging air required to completely clean out the remaining exhaust gases. There can be some variation due to the differing shapes and configurations of combustion chambers and their porting locations; however, it is generally necessary to pump clean air having a volume of at least 2.5 times the volume of the combustion chamber in order to adequately clean out (i.e. scavenge) exhaust gases prior to injecting fuel into the chamber. Representative prior art approaches the problem of rapidly and efficiently scavenging exhaust gases can be seen in U.S. Pat. Nos. 4,403,722; 4,712,379; and 4,759,318.

These patents generally rely on a temperature drop in the gases remaining in the combustion chamber after exhaust gases have been allowed to escape following a power stroke. This temperature drop forms a partial vacuum, causing scavenging air to be drawn in through check valves at the ignition end of the combustion chamber. A critical problem associated with these systems is the speed with which the scavenging operations of this type can be accomplished. As it takes time and temperature drop for a vacuum to be realized after the fastener has been driven, hot gases are allowed to stay in the tool for long periods of time up to 500 milliseconds. This causes the tool to heat up and lose power as well as severely limiting the operating speed of the tool.

SUMMARY OF THE INVENTION

In my current invention, a novel approach has been taken to address the problems described above, allowing rapid automatic operation in a simple device. Unlike my U.S. Pat. No. 4,712,379 and U.S. Pat. No. 4,403,722, which rely on a vacuum being set up and manual operations to complete their cycles, exhaust gases can be more completely scavenged within a much shorter time (e.g., 10 milliseconds) in the cycle of my invention. This allows for very rapid cycling rates and minimal heating of the tool. It shares the advantages of my U.S. Pat. Nos. 4,759,318 and 4,665,868 as its cycle can be initiated solely by electric signal without the need for manual pumps or valves, but does not require numerous complicated valves and seals. Thus, it represents a significant advance in efficiency and simplicity of operation over prior art devices.

The present invention features an improved scavenging system for a gas-powered intermittent motor having a power piston within a piston cylinder that divides the cylinder into a combustion chamber located above the power piston and an air chamber located below the power piston. A plenum chamber connects the air chamber to the combustion chamber. A first check valve located between the air chamber and the plenum chamber supports a flow of air from the air chamber into the plenum chamber. A second check valve located between the plenum chamber and the combustion chamber supports a flow of the air from the plenum chamber into the combustion chamber. The power piston is moveable in response to an ignition of combustion gas in the combustion chamber between a top or starting position at which a volume of the combustion chamber is minimized and a volume of the air chamber is maximized and a bottom position at which the volume of the combustion chamber is maximized and the volume of the air chamber is minimized. The first check valve supports the flow of air from the air chamber into the plenum chamber during the movement of the power piston toward the bottom position, and the second check valve supports the flow of air from the plenum chamber into the combustion chamber when the power piston is located in the vicinity of the bottom position to initiate a scavenging operation in the combustion chamber as pressure in the plenum chamber exceeds pressure in the combustion chamber.

The power piston is powered in a downward stroke by the ignition of combustion gas in the combustion chamber and is preferably biased to return to rest in an upward return stroke, when not powered by the ignition of gas. An exhaust valve associated with the combustion chamber opens to exhaust spent combustion gases and air from the combustion chamber after combustion. The plenum chamber is provided in fluid communication with both the air chamber below the power piston and the combustion chamber above the power piston. In addition, the plenum chamber can be provided in fluid communication with an actuator for the exhaust valve.

Air is compressed in the air chamber below the power piston during the downward movement of the power piston and this compressed air flows through the first check valve into the plenum chamber. The compressed air in the plenum chamber begins to flow through the second check valve into the combustion chamber when the power piston arrives the vicinity of the bottom position. Scavenging air flows from the plenum chamber into the combustion chamber after the pressure in the plenum chamber exceeds the pressure in the combustion chamber, which first occurs when the piston is in the vicinity of the bottom position (e.g., shortly before, at, or after the change in piston direction).

During operation, the motor is configured so that:

a. air is compressed in the air chamber below the power piston during the downward power stroke and this compressed air flows through the first check valve into the plenum chamber;

b. then, as the combustion chamber pressure drops, the compressed air from the plenum chamber flows through the second check valve into the combustion chamber, and subsequently through the exhaust valve, scavenging the combustion chamber of spent combustion gases;

c. as the plenum chamber pressure drops and the piston is on its upward return stroke, the piston draws in air through an air intake valve into the air chamber below the piston while exhaust gases above the piston are being forced out through the exhaust valve; and d. as the pressure in the combustion chamber and the plenum chamber return to substantially atmospheric pressure near the top position of the piston, the exhaust valve closes to ready the motor for fuel injection and ignition.

The first check valve preferably opens during the downward stroke of the power piston, while the intake valve is closed, to admit compressed air into the plenum chamber. The first check valve preferably closes in conjunction with (e.g., at or before) the opening of the intake valve to preserve the increased pressure of the plenum chamber. The second check valve preferably opens in conjunction with (e.g., at or after) the opening of the exhaust valve to provide for efficiently scavenging spent gases from the combustion chamber while also providing a charge of fresh air in the combustion chamber. The second check valve preferably closes in conjunction with (e.g., slightly before, at, or after) the closing of the exhaust valve in preparation for ignition of a fresh charge in the combustion chamber. Air pressure stored in the plenum chamber is preferably used for opening the exhaust valve. However, combustion air pressure from the combustion chamber can also be used for this purpose.

Preferably, the volume of the air chamber exceeds the volume of the combustion chamber at the start of the power piston's downward movement in response to the ignition of combustion gas by a ratio of at least 2.5 to 1.

Figure 1:
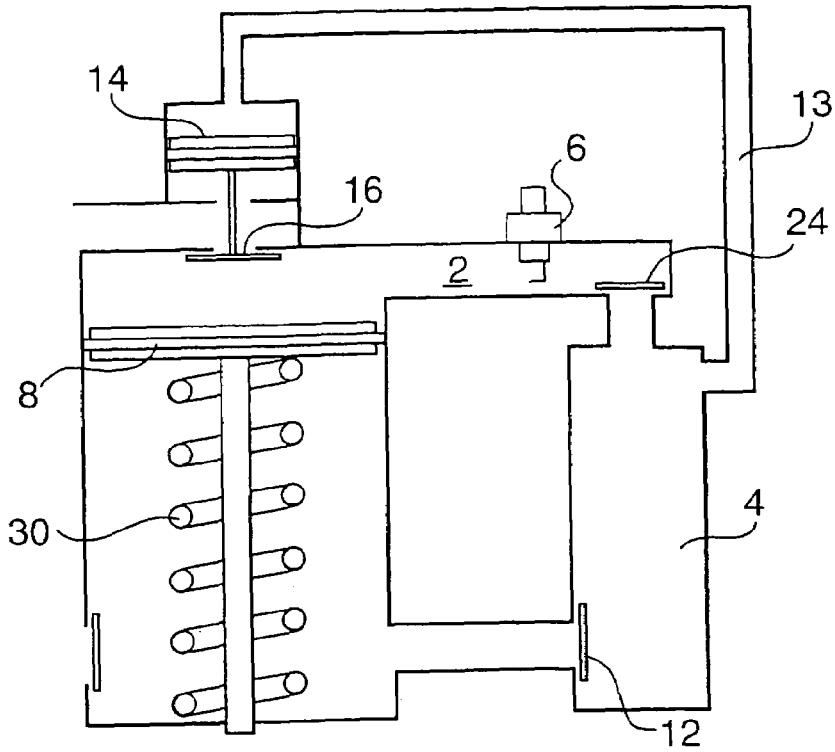
FIG. 1 is a schematic view of the intermittent linear motor system for a fastening tool with the motor ready to fire.

While the invention will be described in conjunction with illustrated embodiments, it will be understood that it is not intended to limit the invention to such embodiments. On the contrary, it is intended to cover all alternatives, modification and equivalents as may be included within the spirit and scope of the invention as defined by the appended claims.

DETAILED DESCRIPTION OF THE PREFERRED EMBODIMENTS

In the drawings, similar features have been given similar reference numerals.

Turning to FIG. 1, there is shown a schematic view of the intermittent linear motor system for a fastening tool ready for ignition. Fuel injection and starting means are not shown for clarity. At this point, a vapoured fuel such as Mapp gas or propane has been injected into the combustion chamber 2 in the correct proportion to create an explosive fuel/air charge, and the tool is ready to fire as a result of a spark from spark plug 6. Typically, a manual starting pump is connected, preferably to the plenum chamber 4, to provide fresh air to the combustion chamber in the event that unburned gases or inaccurate fueling has left a polluted atmosphere in the combustion chamber as my previous U.S. Pat. Nos. 4,759,318 and 4,665,868 more fully describe.

Figure 2:
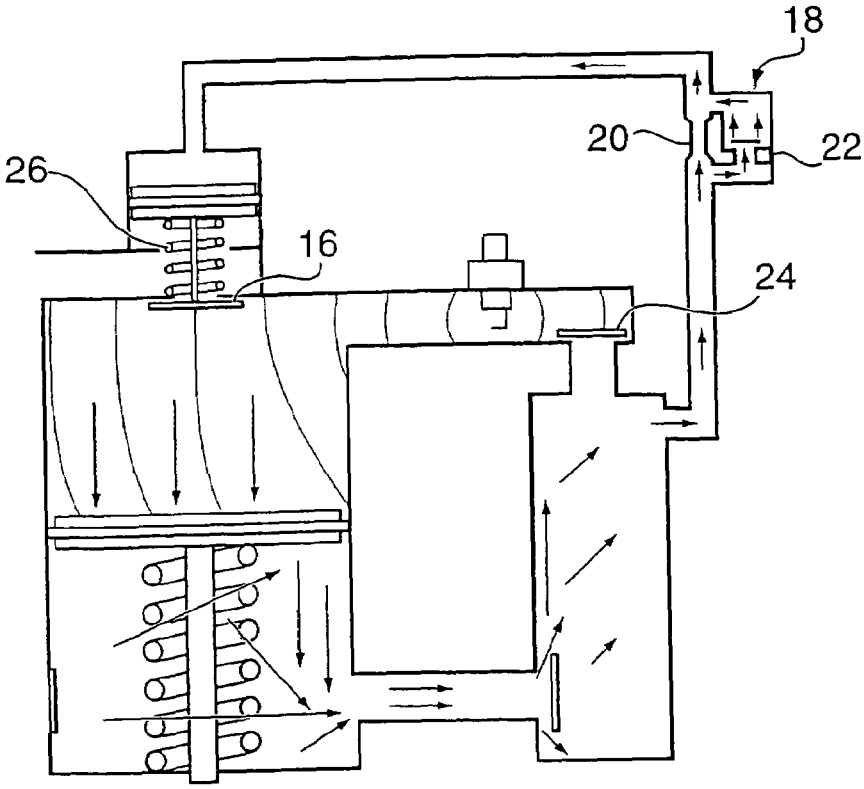
FIG. 2 is a schematic view of the system with the combustible mixture being ignited and the power piston being driven down.

FIG. 2 shows the combustion mixture being ignited with a spark plug 6 and the power piston 8 being driven down along the piston cylinder through its power stroke, and a fastener is driven or other useful work performed. Air within the air chamber 10 below the power piston 8 is being compressed into the scavenging plenum chamber 4 through the plenum check valve 12. Pressure building in the plenum chamber 4 is also being communicated through signal line 13 to the exhaust valve actuator 14 biasing the exhaust valve 16 to open. If desired to more fully control the opening and closing timing of the exhaust valve 16, a check valve/orifice combination 18 (see FIG. 2) can be used to allow rapid opening of the valve whereby air flow to the actuator passes through an orifice 20 and past a check valve 22 during compression and only through the orifice as the pressure decreases during the cycle. (See FIG. 4.) The pressure inside the combustion chamber at this time is relatively high, which holds the exhaust valve 16 closed. Also, the combustion chamber check valve 24 is held closed against the plenum pressure with combustion pressure, the remaining pressure in the combustion chamber 2 being higher than the pressure in the plenum chamber 4.

Figure 3:
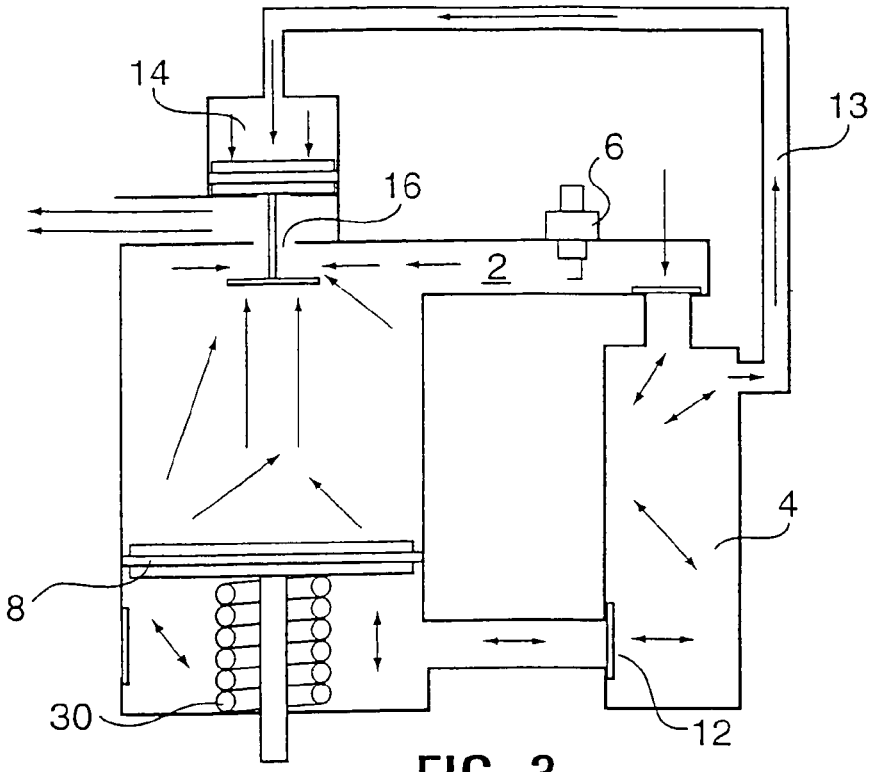
FIG. 3 is a schematic view of the system at the first stage of scavenging as the exhaust valve opens venting excess combustion pressure to atmosphere.

FIG. 3 shows the first stage of scavenging as the power piston 8 arrives in the vicinity of its bottom position (i.e., is located near the bottom of its stroke shortly before, at, or after its change of direction) and as the exhaust valve 16 opens as a result of the high plenum pressure it references and lowered combustion chamber pressure. This vents the combustion chamber 2, and as its pressure lowers towards atmospheric pressure, air begins flowing from the plenum chamber 4 through the combustion chamber 2 displacing exhaust gases from the combustion chamber 2 and out through the open exhaust valve 16. There is also a spring 26 biasing the exhaust valve 16 to close, which is overcome by the plenum pressure on the diaphragm or actuation piston 14 of the actuator (not shown), and again as more fully described in my previous U.S. Pat. Nos. 4,759,318 and 4,665,868.

Simultaneously, the power piston 8 begins to return as the remaining combustion pressure falls and exhaust gases contained in the swept volume above the piston 8 are pushed out through the open exhaust valve 16. In a preferred embodiment, the swept volume of the piston is roughly 2.5 or more times the volume of the combustion chamber 2. Typically the combustion chamber 2 is of a shape and location whereby there is a passageway between the combustion chamber and the swept volume (expansion volume) such that substantially all the scavenging air from the plenum chamber 4 is used to displace exhaust gases from the combustion chamber 2 and substantially all of the gases present in the swept volume above the piston 8 are displaced by the piston 8 through the exhaust valve 16.

As well as the spring 30 or other resilient means biasing the piston 8 upwards, a small amount of compressed air trapped in the air chamber 10 below the piston can add to the initial returning force applied to the piston 8.

Figure 7:
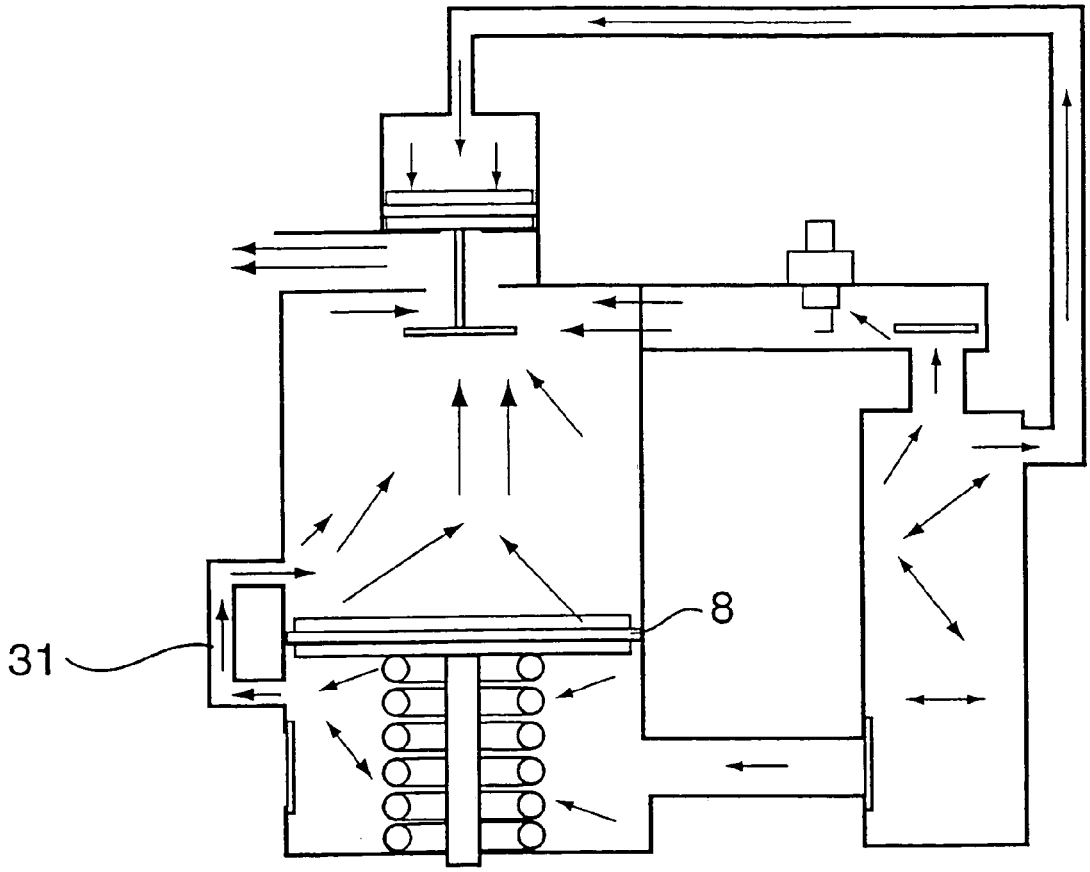
FIG. 7 is a schematic view of an alternative embodiment of the system according to the present invention, in which a bypass vent is provided to enable compressed air within the air chamber beneath the piston to enter the combustion chamber above the piston.

Alternately, as shown in the embodiment of FIG. 7, the air compressed into the air chamber 10 below piston 8 can be bypassed as shown, into the volume of the combustion chamber above the piston as the piston reaches the bottom of its stroke, allowing this amount of otherwise unused air to assist in the cooling and scavenging process. This bypass vent 31 can be in the form of an external line as shown or simply be a channel cut into the cylinder wall at this location.

Figure 4:
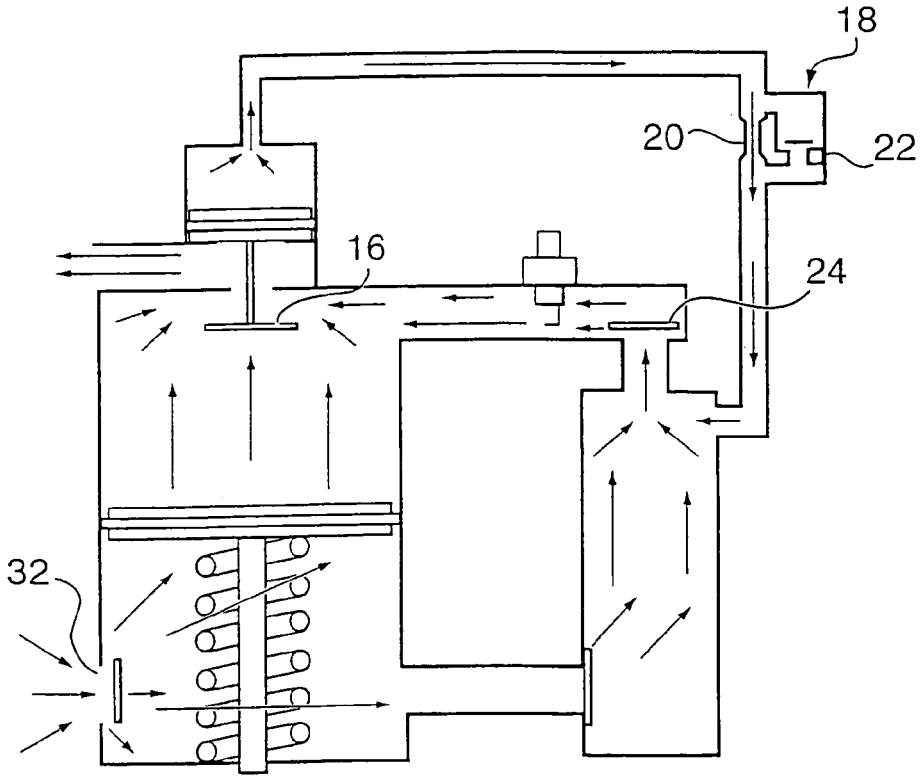
FIG. 4 is a schematic view of the system as the power piston begins to return to its top or starting position exhausting spent gases.

FIG. 4 shows the combustion chamber check valve 24 open during the return of the power piston 8 due to the accompanying pressure drop in the combustion chamber 2. Air from the scavenging plenum chamber 4 passes through the open combustion chamber check valve 24 and flows through the combustion chamber 2 and out the exhaust valve 16 scavenging exhaust gases with it.

Simultaneously, the power piston 8 starts to return by spring 30 or other means to its top or starting position, drawing in air into the air chamber 10 below it through the air inlet valve 32 while forcing exhaust out of the combustion chamber 2 through the exhaust valve 16 above it. Pressure in the scavenging plenum chamber 4 is dropping at this time, and air is beginning to flow back from the exhaust valve actuator 14. As previously stated, it may be desirable to place an orifice or check valve/orifice combination 18 to tailor the opening and closing profiles of the exhaust valve 16, whereby the valve 16 would open quickly but close slowly so that pressure in the plenum chamber 4 could drop to atmospheric pressure before the exhaust valve 16 closes.

Air to be compressed in the next cycle is simultaneously drawn into the air chamber 10 below the power piston 8 through an inlet means such as a check valve 32 as the piston 8 returns. Once substantially all the pressure above atmospheric has been vented through the combustion chamber 2, the exhaust valve 16 closes.

Figure 5:
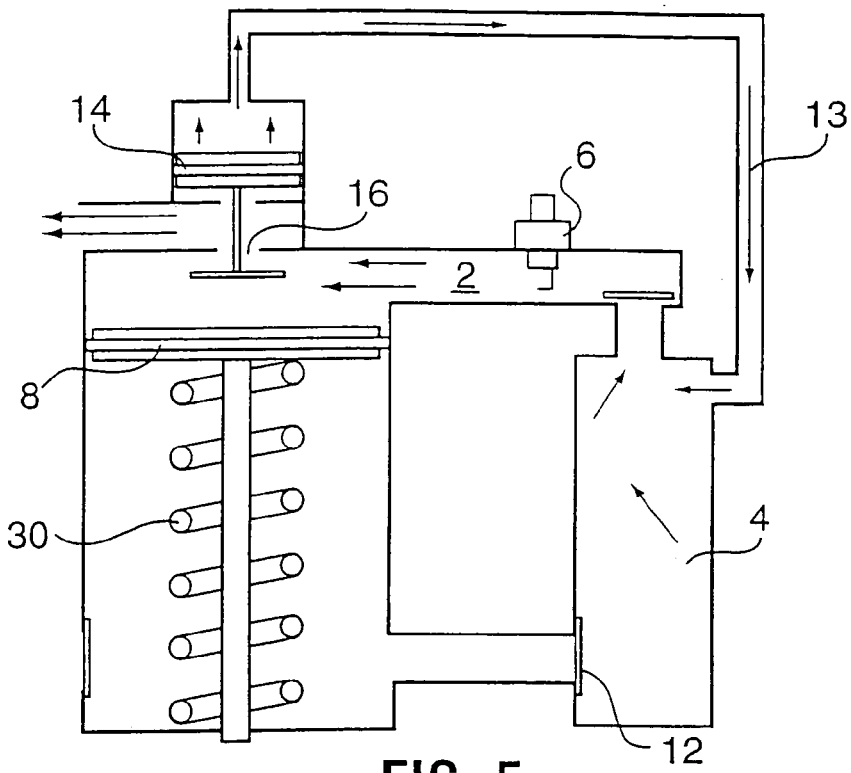
FIG. 5 is a schematic view of the system showing the power piston at rest in its top or starting position and the remaining valves closing.

FIG. 5 shows the power piston 8 at rest in its top or starting position and the exhaust valve 16 and the combustion chamber valve 24 closing as the pressure in the plenum chamber 4 drops to near atmospheric. Once these valves 16 and 24 have closed, fuel can be injected and the cycle initiated again with a spark being delivered to the spark plug.

Figure 6:
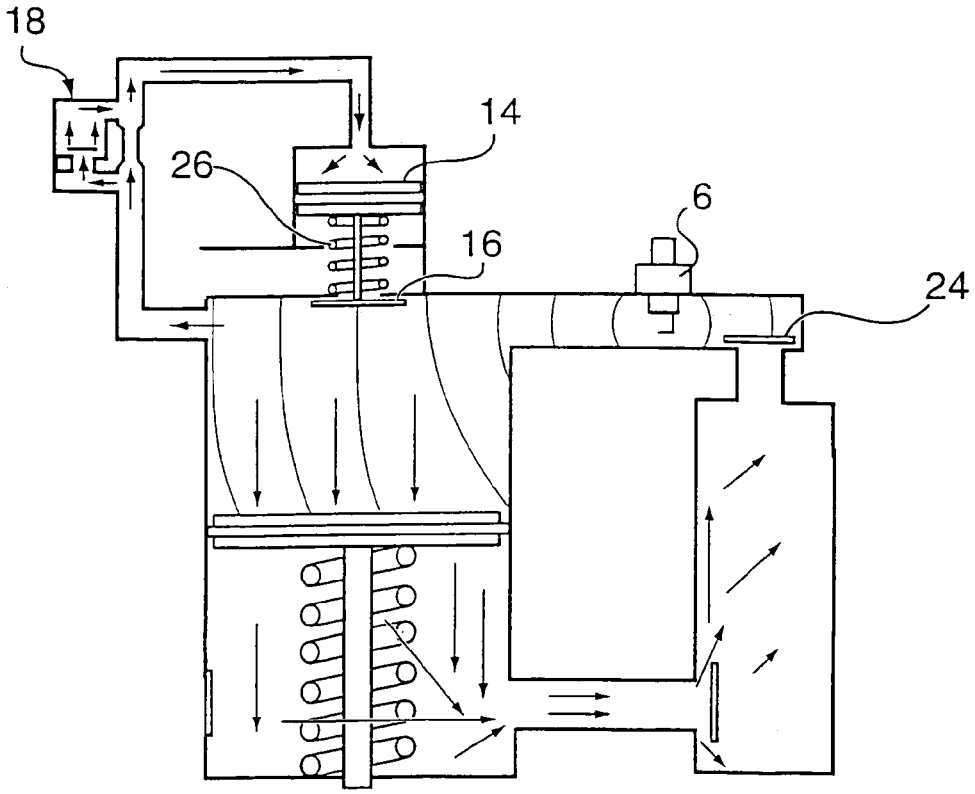
FIG. 6 is a schematic view of an alternative embodiment of the system according to the present invention, in which the system is arranged so that the pressure to acuate the exhaust valve is sourced from combustion pressure.

FIG. 6 shows an alternative embodiment of the motor according to the present invention wherein the combustion chamber 2 communicates with exhaust valve actuator 14, preferably through a check valve/orifice combination 18 (similar to that of FIG. 2), so that exhaust valve 16 is actuated to move to an open position by combustion gases generated in combustion chamber 2.

In operation, the very rapid cycling rates and minimal heating of the tool provides an efficient, effective intermittent linear motor. Similar details are supported in my U.S. Pat. No. 6,491,002, which is hereby incorporated by reference.

Thus, it is apparent that there has been provided in accordance with the invention an intermittent linear motor that fully satisfies the objects, aims and advantages set forth above. While the invention has been described in conjunction with illustrated embodiments thereof; it is evident that many alternatives, modifications and variations will be apparent to those skilled in the art in light of the foregoing description. Accordingly, it is intended to embrace all such alternatives, modifications and variations as fall within the spirit and broad scope of the invention.

What is claimed is:

1. A scavenging system for a gas-powered intermittent engine comprising:

a power piston within a piston cylinder that divides the piston cylinder into a combustion chamber located above the power piston and an air chamber located below the power piston;

a plenum chamber connecting the air chamber to the combustion chamber;

a first check valve located between the air chamber and the plenum chamber supporting a flow of air from the air chamber into the plenum chamber;

a second check valve located between the plenum chamber and the combustion chamber supporting a flow of the air from the plenum chamber into the combustion chamber;

the power piston being moveable in response to an ignition of combustion gas in the combustion chamber between a top position at which a volume of the combustion chamber is minimized and a volume of the air chamber is maximized and a bottom position at which the volume of the combustion chamber is maximized and the volume of the air chamber is minimized;

the first check valve supports the flow of air from the air chamber into the combustion chamber during the downward movement of the power piston toward the bottom position; and the second check valve supports the flow of air from the plenum chamber into the combustion chamber when the power piston is in the vicinity of the bottom position to initiate a scavenging operation in the combustion chamber as pressure in the plenum chamber exceeds pressure in the combustion chamber.

2. The system of claim 1 in which air is compressed in the air chamber below the power piston during the downward movement of the power piston and this compressed air flows through the first check valve into the plenum chamber.

3. The system of claim 2 in which the compressed air in the plenum chamber begins to flow through the second check valve into the combustion chamber when the power piston arrives the vicinity of the bottom position.

4. The system of claim 3 in which the power piston draws air into the air chamber in response to an upward movement toward the top position of the power piston.

5. The system of claim 4 in which the second check valve is closed when the power piston is located in the vicinity of the top position to ready the combustion chamber for ignition.

6. The system of claim 1 further comprising an exhaust valve that is closed during the downward movement of the power piston and is opened during an upward movement of the power piston toward the top position for exhausting spent combustion gas from the combustion chamber.

7. The system of claim 1 in which the exhaust valve is biased to a closed position for blocking the flow of gas from the combustion chamber.

8. The system of claim 7 further comprising an exhaust valve actuator in fluid communication with the plenum chamber for opening the exhaust valve when a force as a result of pressure within the plenum chamber acting on the exhaust valve actuator exceeds a force as a result of pressure within the combustion chamber acting on the exhaust valve.

9. The system of claim 1 in which the second check valve is biased to a closed position for blocking the flow of air between the plenum chamber and the combustion chamber.

10. The system of claim 1 in which the volume of the air chamber exceeds the volume of the combustion chamber at the start of the power piston's movement in response to the expansion of combustion gases by a ratio of at least 2 to 1.

11. A combustion powered intermittent linear motor comprising:

a combustion chamber and an air chamber within a piston cylinder;

an associated power piston reciprocating in the piston cylinder, the piston powered in a power stroke by ignition of gas in the combustion chamber and arranged to return to rest in a return stroke, when not powered by the ignition of gas;

an exhaust valve associated with the combustion chamber, which valve opens to exhaust spent combustion gases and air from the combustion chamber after combustion;

a plenum chamber being in fluid communication with the air chamber below the piston remote from the combustion chamber, the plenum chamber further being in communication with the combustion chamber, the motor being configured so that:

(a) air is compressed in the air chamber below the power piston during the power stroke and this compressed air flows into the plenum chamber;

(b) then, as the combustion pressure drops, the compressed air from the plenum chamber flows through the combustion chamber, and subsequently through the exhaust valve, scavenging the combustion chamber of spent combustion gases;

(c) as the plenum chamber pressure drops and the piston is on its return stroke, the piston draws in air into the air chamber from below it through an air inlet while exhaust gases in the combustion chamber above the piston are being forced out through the exhaust valve; and (d) as the pressure in the combustion chamber and the plenum chamber return to substantially atmospheric pressure, the exhaust valve closes in preparation for igniting the combustion chamber, wherein the compressed air from the plenum chamber enters the combustion chamber near the start of the power piston's return stroke.

12. The motor of claim 11 in which the plenum chamber is in fluid communication with the combustion chamber through a combustion chamber check valve.

13. The motor of claim 12 in which the combustion chamber check valve is biased to a closed position for blocking the flow of air between the plenum chamber and the combustion chamber.

14. The motor of claim 13 in which the exhaust valve is biased to a closed position for blocking flows of gas from the combustion chamber.

* * * * *